US008056383B2

(12) United States Patent
Handing

(10) Patent No.: US 8,056,383 B2
(45) Date of Patent: Nov. 15, 2011

(54) METHOD OF REHEATING STEEL PART

(75) Inventor: Christian Handing, Langenberg (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 373 days.

(21) Appl. No.: 12/428,005

(22) Filed: Apr. 22, 2009

(65) Prior Publication Data

US 2010/0101296 A1 Apr. 29, 2010

(30) Foreign Application Priority Data

Apr. 29, 2008 (DE) ..... 10 2008 021 492

(51) Int. Cl.
*B21D 31/00* (2006.01)

(52) U.S. Cl. ..... 72/342.6; 72/364; 72/342.5; 148/639

(58) Field of Classification Search ..... 72/342.1, 72/342.5, 342.6, 364; 148/639–644
See application file for complete search history.

(56) References Cited

U.S. PATENT DOCUMENTS

| | | | | |
|---|---|---|---|---|
| 3,889,510 | A * | 6/1975 | Yamakoshi et al. | 72/364 |
| 5,916,389 | A | 6/1999 | Lundstroem | 148/640 |
| 5,972,134 | A | 10/1999 | Buschsieweke | 148/567 |
| 7,041,181 | B2 * | 5/2006 | Gosmann | 148/537 |
| 7,077,920 | B2 * | 7/2006 | Gehringhoff | 148/530 |
| 2004/0112485 | A1 | 6/2004 | Reinhold | 148/639 |
| 2007/0107819 | A1 | 5/2007 | Gehringhoff | 148/639 |
| 2008/0041505 | A1 | 2/2008 | Reinhold | 148/627 |

FOREIGN PATENT DOCUMENTS

DE 2452486 10/1985

* cited by examiner

*Primary Examiner* — Shelley Self

(74) *Attorney, Agent, or Firm* — Andrew Wilford

(57) ABSTRACT

A steel part with regions of different ductility is made by first loading the part onto a heatable rack and then heating the rack with the part on it in a furnace to a temperature above the $AC_3$ point of the part. The part is then removed from the rack and loaded while still above the $AC_3$ point into a press where it is shaped and hardened. In the press the part is engaged by tools that deform it and that cool it quickly to well below the $AC_3$ point. Finally, before the rack has cooled substantially, the shaped and hardened part is taken out of the press and placed on the rack with predetermined regions of the part in heat-conducting engagement with the rack such that the ductility of the predetermined regions is increased by transfer of the residual heat from the rack to the predetermined regions.

11 Claims, 5 Drawing Sheets

METHOD OF REHEATING STEEL PART

FIELD OF THE INVENTION

The present invention relates to a method of making a differentially hardened steel part, that is a steel part with regions of different ductility. More particularly this invention concerns the second reheating step used to reduce the ductility of a fully hardened steel part.

BACKGROUND OF THE INVENTION

The standard procedure of making a steel part with regions of different ductility comprises the steps of sequentially:

- passing the part on a rack through a furnace and heating it therein to above the $AC_3$ point of the alloy;
- shaping and hardening the part in a press, which process hardens the entire part;
- removing the part from the press; and
- targeted reheating of predetermined regions of the parts to increase ductility in these regions.

In automobile manufacture more and more structural parts of sturdy and high-strength steel are being used to meet the lightweight construction criteria for rising demands on material tolerances. This applies also for vehicle body construction, where for example structural and/or safety parts such as door impact pillars, A and B columns, fenders or longitudinal and cross beams are being manufactured from heat-shaped and press-hardened strong or high-strength steel more and more frequently to meet weight goals and safety requirements.

DE 24 52 486 discloses a method of shaping and hardening sheet steel with minimal material thickness and good dimensional stability, in which a sheet of boron-alloy steel is heated to a temperature above the $AC_3$ point and is then shaped in less than 5 seconds into the final shape between two indirectly cooled tools with substantial shaping. Then it is subjected to rapid cooling while still in the die to produce a martensitic and/or bainitic structure (direct thermoshaping). These measures produce a product having good dimensional accuracy and high mechanical strength, a product that is eminently suited for use as a structural and safety part in an automobile.

It is also known from the prior art to first cold-preform a sheet metal blank made of boron-alloyed steel in the unhardened state, then to heat the pre-shaped part to a temperature over $AC_3$ and then to shape it in under 5 seconds into the final shape between two indirectly cooled tools and subject it to rapid cooling while still in the die to produce a martensitic and/or bainitic structure (indirect thermoshaping). In this process the degree of pre-heating can reach 100% of the finished shape so that the part is first and foremost calibrated to size in the finished shape in the thermoshaping tool. Both the direct and the indirect process are referred to below as thermoshaping and press-hardening.

U.S. Pat. No. 5,972,134 discloses providing a sheet metal blank of hardenable steel for making a shaped metallic part for an automobile part having regions with high ductility, then first homogeneously heating this sheet metal blank to a temperature between 900° C. and 950° C., and subsequently shaping the sheet metal blank in a shaping tool into the shaped part. Finally the shaped part is tempered while still in the shaping tool to then bring adjoining partial regions of the shaped parts to a temperature between 600° C. and 900° C. in a time of less than 30 seconds. In this way, regions with high ductility are shaped in the sheet metal blank. At temperatures between 600° C. and 900° C. substantial structural transformation takes place in the grain of the steel, meaning that the mechanical values are redirected in the direction of unhardened steel. The steel is accordingly no longer high strength in the ductile regions. This patent proposes undertaking partial thermal treatment on the shaped part fixed on a feed mechanism by means of inductive heating.

US 2007/0107814 describes a thermoshaped and press-hardened structural part that has been thermotreated following a heat-forming and press-hardening process at 320 to 400° C. The high-strength properties of the part are locally influenced by this thermal treatment. The yield strength $R_{p0.2}$ and the expansion $A_5$ remain virtually unchanged. Only the tensile strength RM is reduced by 100 to 200 N/mm$^2$. With a grade of steel composed in weight percent of

- Carbon (C) 0.18% to 0.3%
- Silicon (Si) 0.1% to 0.7%
- Manganese (Mn) 1.0% to 2.5%
- Phosphorous (P) maximal 0.025%
- Chromium (Cr) to 0.8%
- Molybdenum (Mo) to 0.5%
- Sulfur (S) maximal 0.01%
- Titanium (Ti) 0.02% to 0.05%
- Boron (B) 0.002% to 0.005%
- Aluminum (Al) 0.01% to 0.06%, and
- balance iron, including contaminants conditional on steel production, a tensile strength Rm of 1200 to 1400 N/mm$^2$, a yield strength $R_{p0.2}$ of 950 to 1250 N/mm$^2$ and an expansion $A_5$ of 6-12% result following thermal treatment at 320 to 400° C. The material still has the required high-strength mechanical properties, though due to the slightly lower tensile strength Rm the material is so ductile that it puckers under load instead of breaking or tearing.

U.S. Pat. No. 5,916,389 discloses a method of manufacturing a sheet steel product by heating a sheet cut to size, thermoshaping the sheet steel between pair of tools, and hardening the shaped product by rapid cooling from the austenitic temperature while it is still between the tools, and finally processing the product such that unhardened regions remain in it and processing is carried out in such unhardened regions. In this process, there is an alternative whereby the entire product is hardened in the tools and then the regions in which the processing is completed are tempered in a separate process. In such a case the tempering can be done immediately after the procedure by a machine, such as for example a punch, which has a heating device such as for example an built-in induction element.

US 2004/0112485 and 2008/0041505 disclose a system where the interior of a furnace is partitioned into two longitudinally extending and transversely adjacent zones, and one of the zones is heated to a substantially higher treatment temperature than the other of the zones, which may or may not be heated. A steel workpiece is conveyed longitudinally through the furnace with a region of the workpiece moving exclusively through the one zone and another region of the workpiece moving exclusively through the other of the zones such that the regions are heated to different temperatures. The treatment temperature in one of the zone is above the $AC_1$ point for the workpiece and the temperature in the other of the zones is close to or below the $AC_1$ point for the workpiece. Thus the use of pass-through furnaces for heating parts to a temperature over the $AC_1$ or $AC_3$ point of the alloy is standard in current production of thermoshaped and press-hardened automobile parts.

OBJECTS OF THE INVENTION

It is therefore an object of the present invention to provide an improved method of reheating steel part.

Another object is the provision of such an improved method of reheating steel part that overcomes the above-given disadvantages, in particular that provides a simple way for the targeted reheating of hardened parts, which is particularly well suited for mass production.

SUMMARY OF THE INVENTION

A steel part with regions of different ductility is made by first loading the part onto a heatable rack and then heating the rack with the part on it in a furnace to a temperature above the $AC_3$ point of the part. The part is then removed from the rack and loaded while still above the $AC_3$ point into a press where it is shaped and hardened. In the press the part is engaged by tools that deform it and that cool it quickly to well below the $AC_3$ point. Finally, before the rack has cooled substantially, the shaped and hardened part is taken out of the press and placed on the rack with predetermined regions of the part in heat-conducting engagement with the rack such that the ductility of the predetermined regions is increased by transfer of the residual heat from the rack to the predetermined regions.

The basis of the invention is the idea that the racks must be used for heating already pre-shaped parts anyway for passing through the furnace. Flat sheet metal blanks, which are reshaped and hardened one after the other in the thermoshaping tools, can run through the furnace via rollers. Pre-shaped, in particular already bent parts would get caught up however, and for that reason these parts are normally carried on racks and heated along with the rack while passing through the furnace. In the process, the rack is unavoidably also heated. After passing through the furnace with parts laid on them, the racks are heated to a temperature of around 900° C. After the part is removed from the rack up to now the heated rack for example travels back is empty through an unheated zone or passage of the furnace on a roller conveyor. During this return action the temperature of the rack falls to around 400° to 600° C. This heat capacity is now utilized as per the invention to locally reheat the hardened parts in predetermined regions.

The parts leave the furnace and move downstream toward the press at a temperature above the $AC_3$ point of the alloy. With the grade of steel of US 2007/0107814 mentioned above the temperature of the parts is around 930° C. on when they exit the furnace. In the thermoshaping tool the temperature then falls abruptly from contact with the shaping/hardening tools, which are generally cooled. On removal from the shaping/hardening tools the parts as a rule have a residual heat temperature of 100° to 200° C. The structural transformation and thus hardening is completed at these temperatures in combination with the necessary dwell time in the press. If the hardened parts are now again placed in predetermined regions on the racks, which are still at around 900° C. after passing through the furnace, the residual heat of the racks in the contact regions is sufficient with the part for an effect on the adjusted structure.

The effect can be precipitated by annealing, the purpose of which is to boost the deformability or ductility of hardened parts and diminish the risk of tearing. Annealing as used below means heating to temperatures between 300° and 900° C. and holding at this temperature with subsequent appropriate cooling. By way of example annealing is supposed to lead to relaxing or similar altered behavior of the modified high-strength grain structure of the steel via a relatively minimal drop in strength and hardening. With the grade of steel of above-cited US 2007/0107814 the high-strength properties of the part are influenced locally by thermal treatment at 320 to 400° C. The $R_{p0.2}$ yield strength and the $A_5$ expansion remain virtually unchanged. Only the Rm tensile strength is reduced by 100 to 200 N/mm$^2$. The material still has the required high-strength mechanical properties, but due to the slightly lesser tensile strength Rm the material is again ductile enough that it deforms under load, without breaking or tearing.

Targeted reheating is effective in particular also in those regions where the part is to be processed mechanically following hardening. By way of example, holes are made or cuts are made to the permissible extent of tolerance, if required. A slight drop in the hardening values makes subsequent remachining easier. It is particularly advantageous however if the martensite and bainite constituents resulting from thermoshaping and press-hardening in the steel structure at least partially revert to ferrite and perlite. The heat input is in this case brought in at a high enough level and for long enough to result in structural transformation to return the grain structure to what it was prior to hardening.

It is decisive that the predetermined regions have good heat-heat transfer contact with the racks so that heat is transferred to the desired region in the required quantity and does not radiate into regions where the hardening is not to be altered. Accordingly, the contact face of the part on the rack is made to engage only the predetermined regions during the reheating process. Also, the heat input to the part can be controlled via the temperature of the rack, the rack mass, the alloy composition of the rack and the dwell time of the already hardened part on the rack. A temperature range of the racks on during the detempering/annealing step is between 300° C. and 930° C. and treatment time is 2 to 6 minutes. The temperature of the rack can be lowered for example by blowing, spray cooling, or additional dwell time outside the furnace. In order to accommodate deviation of structural part geometry of the pre-shaped part from the geometry of the part end-shaped after thermoshaping and press-hardening, the racks are configured for example such that they can be switched correspondingly by robots to again take up the end-shaped parts.

To ensure a continuous manufacturing process the racks must move in a closed circuit from the furnace inlet to the furnace outlet and back. According to the invention this can be done by feeding unhardened cold parts into the furnace and removing reheated hardened parts at almost the same place, reducing the space for handling the parts at this point. This can be done by providing the furnace with a first hot tunnel or zone through which the racks and workpieces pass for heating to above the $AC_3$ point and a parallel return tunnel or zone through is which the racks and hardened workpieces pass during the annealing step. Thus, relative to the downstream travel direction of the workpieces, the parts heated to above the $AC_3$ temperature are taken off the racks and moved downstream (in the direction D) to the thermoshaping press, and on the other hand already hardened parts are put back on the still warm racks before they are moved oppositely back upstream through the cold or unheated tunnel.

BRIEF DESCRIPTION OF THE DRAWING

The above and other objects, features, and advantages will become more readily apparent from the following description, reference being made to the accompanying drawing in which.

SPECIFIC DESCRIPTION

Figure 6:
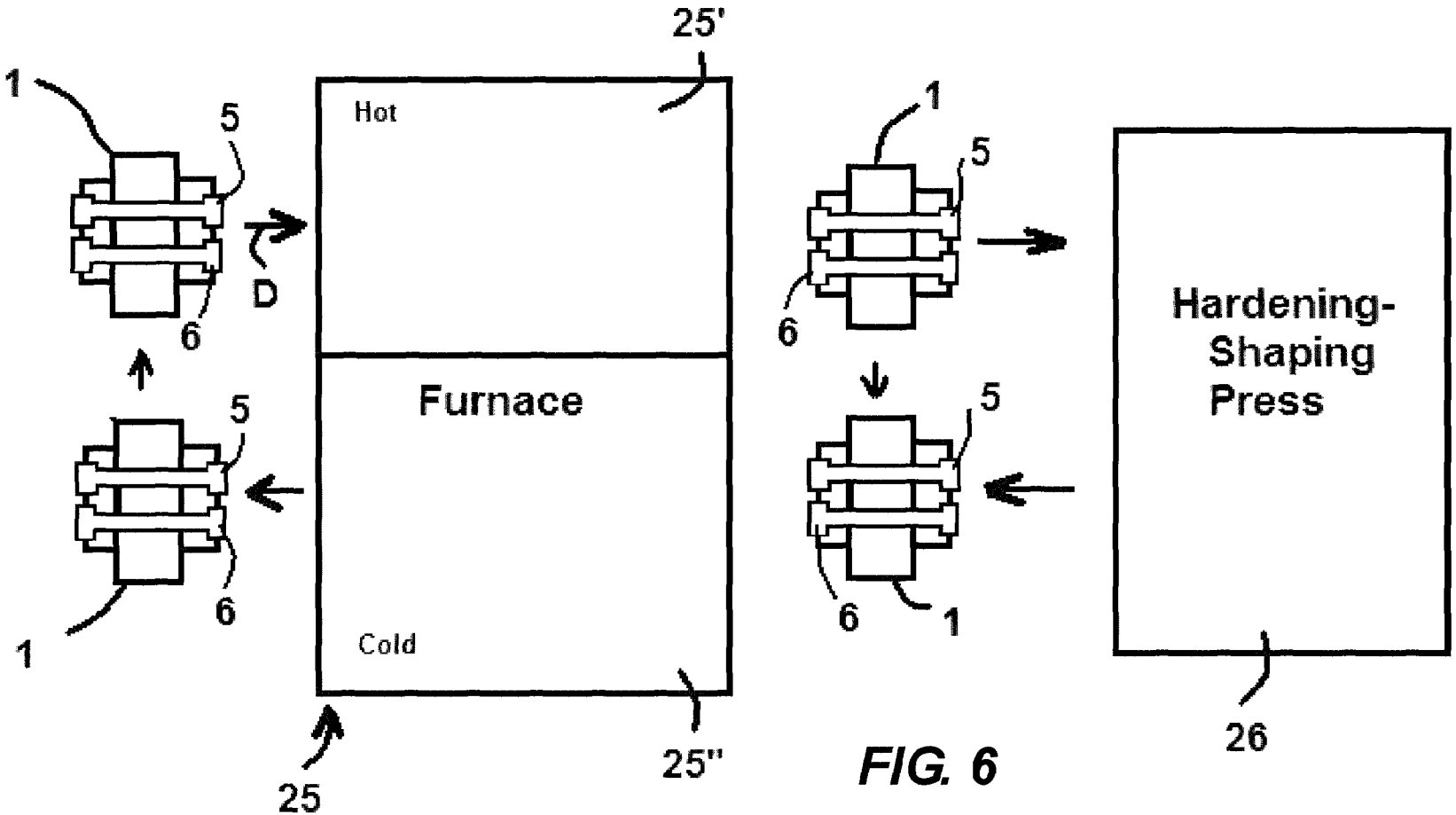
FIG. 6 is a schematic diagram of the method according to the invention.

With reference at first to FIG. 6, workpieces that are steel parts 5 and 6 to be provided with regions of different ductility, are first loaded onto heatable racks 1. These workpieces 5 and 6 normally conform at least generally to their intended final shape.

The racks 1 are then conveyed in a horizontal travel direction D through a hot side or zone 25' of a furnace 25 where the workpieces 5 and 6 and the racks 1 are heated to above the $AC_3$ point of the steel of the workpieces 5 and 6.

On exiting the furnace 25 in the direction D the workpieces 5 and 6 are taken off the racks 1 and loaded into a shaping/hardening press having cooled dies or tools that are clamped on the workpieces to rapidly drop their temperatures to well below the $AC_3$ point while deforming them into their final shape. This process not only shaped the workpieces 5 and 6, but also permanently changes the grain structure of their steel, thereby hardening them. Meanwhile the still hot racks are moved transversely to the direction D at the outlet side of the furnace 25.

The workpieces 5 and 6 are then taken out of the press and loaded back onto the still hot racks 1 which are then moved opposite the direction D through the unheated or "cold" zone 25" of the furnace 25 to its upstream intake side. While moving back upstream the residual heat in the racks 1 is transmitted to those regions of the workpieces 5 and 6 they are in direct contact with, and these regions are detempered, basically restoring their grain structure to the more ductile grain structure they had before entering the hot zone 25' of the furnace 25.

Figure 1:
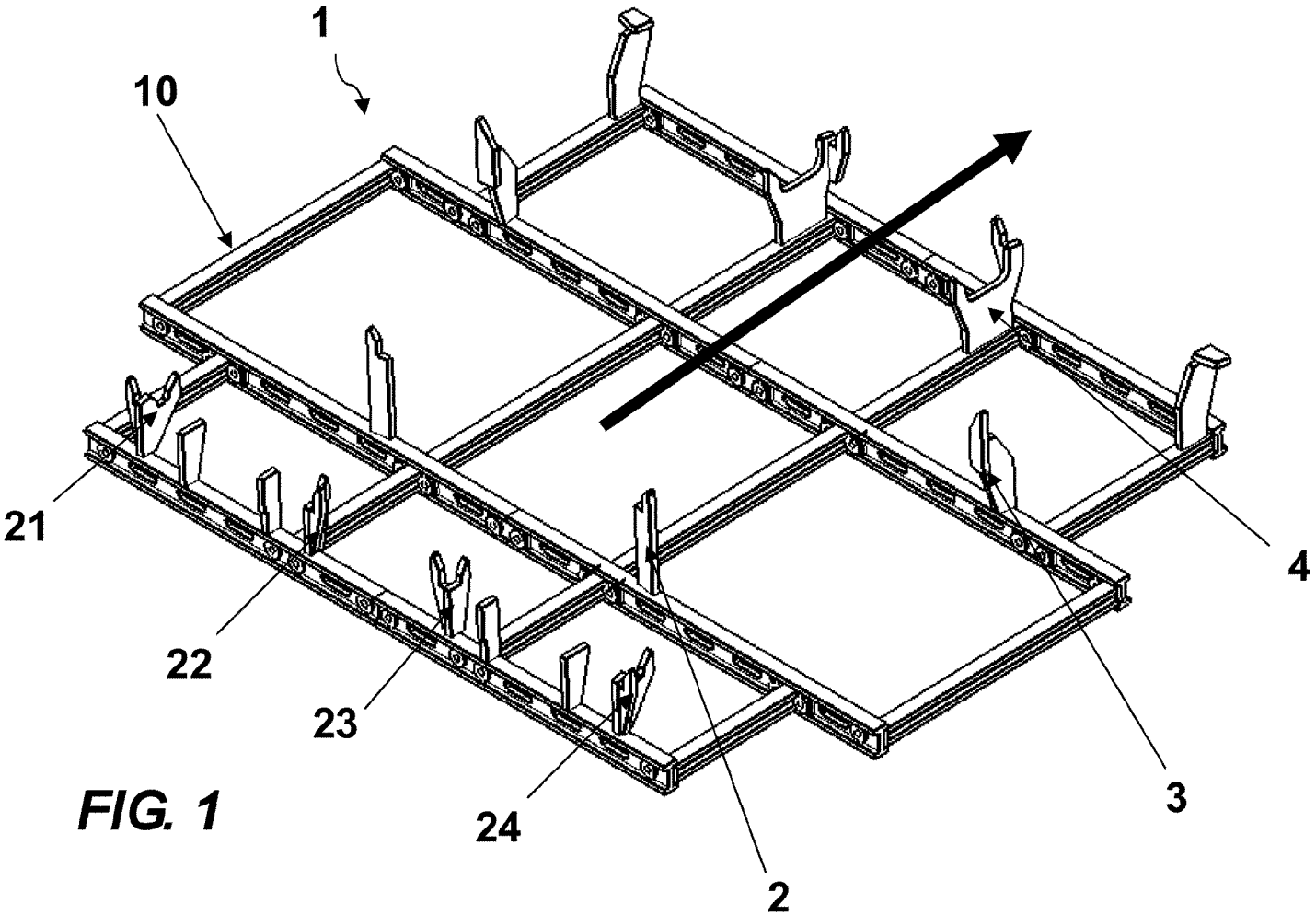
FIG. 1 is a perspective view of a transport rack for carrying out the method of this invention.

As seen in FIG. 1 the transport rack 1 has holders 2-4 and 21-24. The rack 1 comprises a base frame 10 on which several different holders are located. The purpose of the holders 2 to 4 and 21 to 24 is to keep a workpiece 5 or 6, here a B column, in position while passing through the furnace 25.

Figure 2:
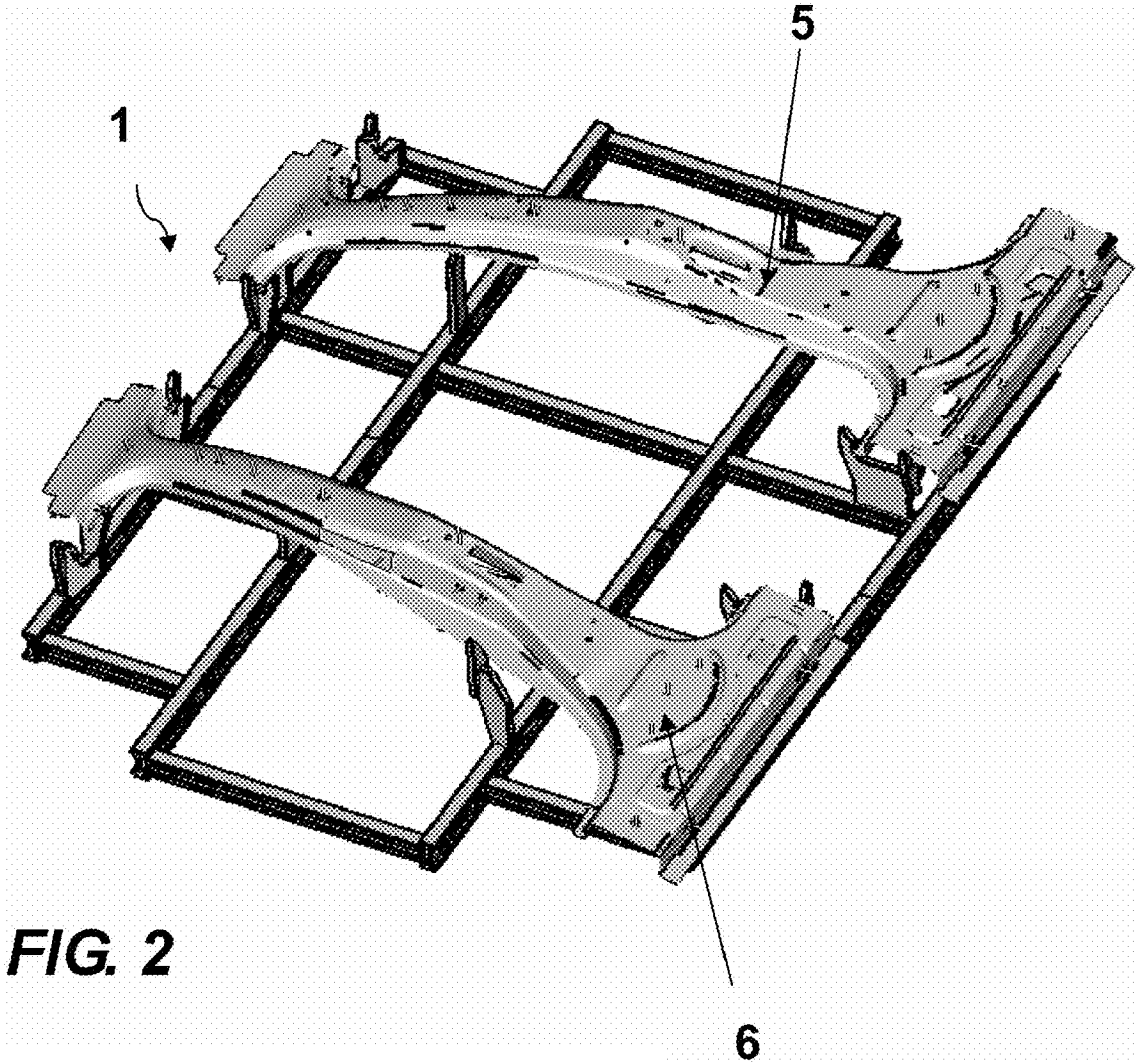
FIG. 2 is another perspective view of the transport rack loaded with two B-columns to be heated.

FIG. 2 shows the transport rack 1 carrying two B columns 5 and 6, for passage through the furnace 25. The B columns 5 and 6 lie on the holders 2-4 and 21-24 and are transported precisely positioned through the furnace 25.

Figure 3:
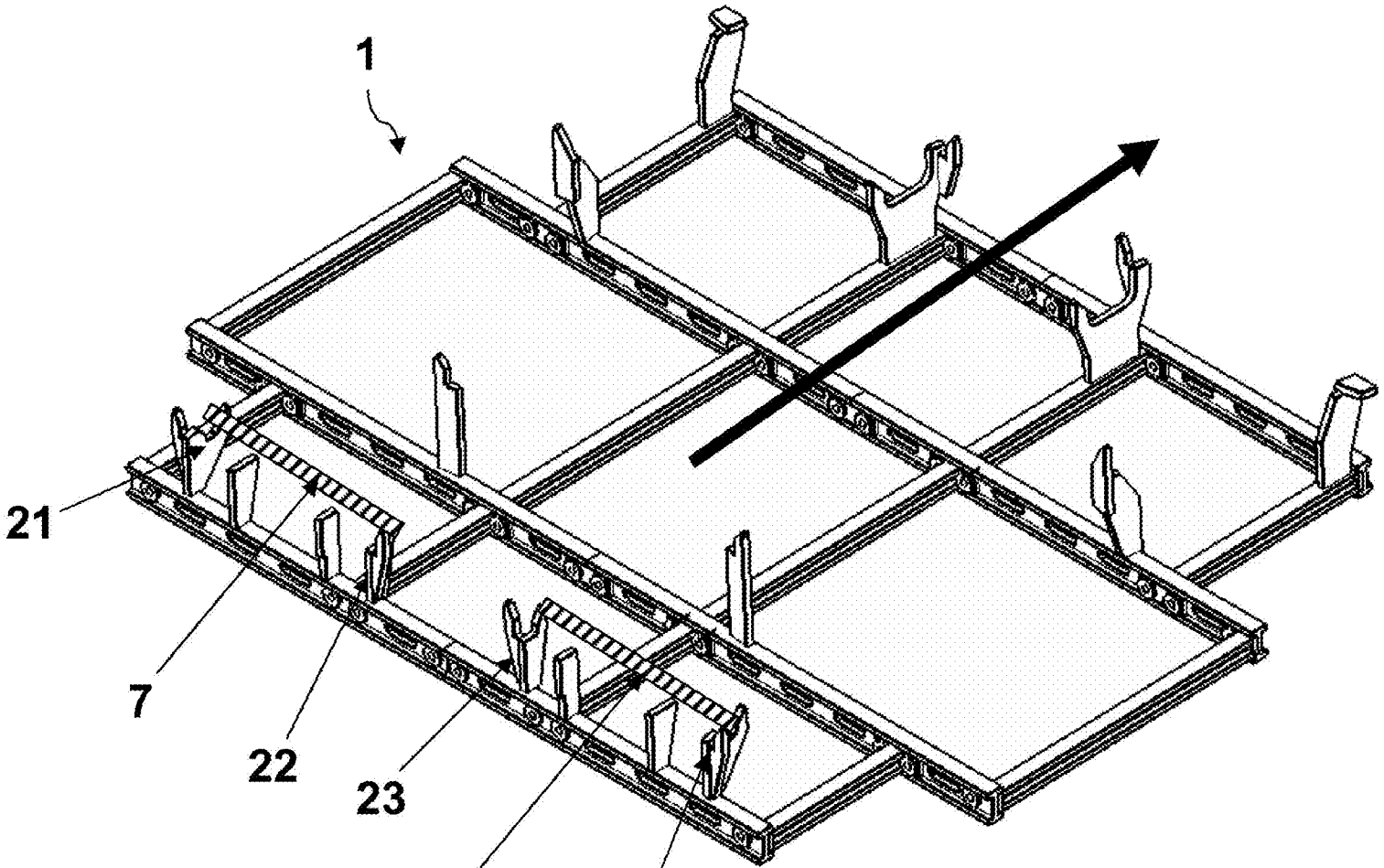
FIG. 3 is another perspective view of the transport rack modified for carrying already hardened B columns.

FIG. 3 shows the heated transport rack 1 after passing through the furnace 25. Contact blocks or rails 7 and 8, which previously had been carried along and heated in the furnace 25, have been laid on the rear holders 21-24. The purpose of these contact rails 7 and 8 is to ensure heat transfer from the warm transport rack 1 to the contact face of the already hardened B columns on returning through the unheated zone 25" of the furnace 25.

Figure 4:
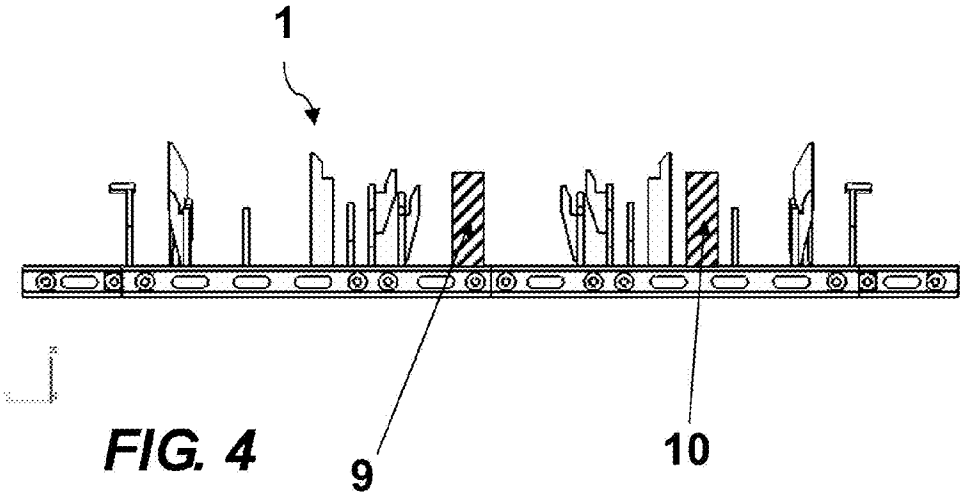
FIGS. 4 and 5 are side views of the transport rack modified to receive already hardened B columns.

FIG. 4 shows the transport rack 1 in a side elevation. Located on the transport rack 1 near the structural holders 2-4 and 21-24 are additional separate holders 9 and 10 for targeted introduction of heat, and are switchable separately. The purpose of these switchable holders 9 and 10 is to accommodate a difference in shape between a pre-shaped part on the way through the furnace 25 in the direction of a thermoshaping press and the part with its final shape on the way back through the unheated zone 25" of the furnace 25.

Figure 5:
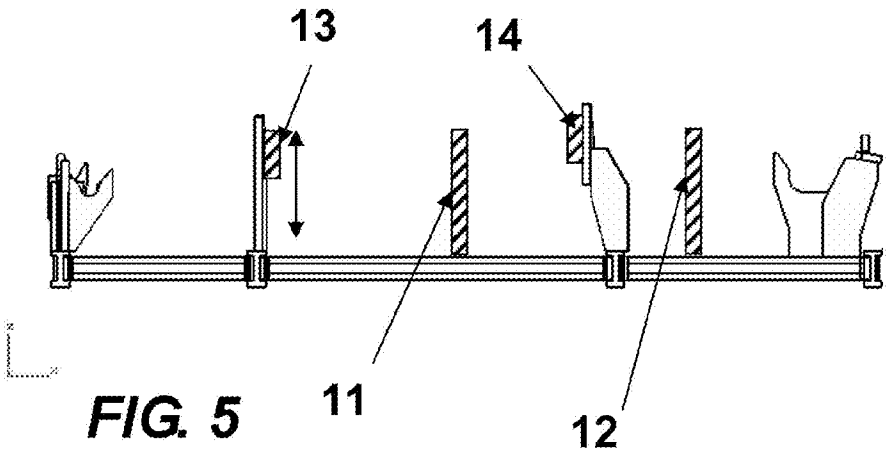

FIG. 5 shows the transport rack 1 in another side elevation. On the one hand separate additional holders 11 and 12 which are fitted on only after passing through the furnace 25 in the direction of the press are illustrated here. On the other hand additional blocks 13 and 14, which can be shifted up and down in the direction of the arrow, are arranged on the structural holders 2-4 and 21-24 themselves for more heat capacity. The rack derives additional flexibility from this switching capacity.

I claim:

1. A method of making a steel part with regions of different ductility, the method comprising the steps of sequentially:

a) loading the part onto a heatable rack;

b) heating the rack with the part on it in a furnace to a temperature above the $AC_3$ point of the part;

c) removing the part from the rack and loading the part while still above the $AC_3$ point into a press;

d) shaping and hardening the part in the press; and e) before the rack has cooled substantially, taking the shaped and hardened part out of the press and placing the shaped and hardened part back on the rack with predetermined regions of the part in heat-conducting engagement with the rack such that the ductility of the predetermined regions is increased by heat transfer from the rack.

2. The method defined in claim 1 wherein in the press the part is engaged by tools that deform it and that cool it quickly to well below the $AC_3$ point.

3. The method defined in claim 1 wherein the predetermined regions of the shaped and hardened part are annealed by contact with the rack.

4. The method defined in claim 2 wherein the predetermined regions are sufficiently annealed that the predetermined regions are detempered.

5. The method defined in claim 3 wherein the predetermined regions are detempered to a molecular structure generally the same as they had before heating in the furnace.

6. The method defined in claim 1 wherein the rack and part are passed through the furnace.

7. The method defined in claim 6 wherein the furnace has an unheated zone and the part is moved in step e) by the rack through the unheated zone.

8. The method defined in claim 7 wherein during step b) the rack and part are moved in one direction through the furnace and during step e) they are moved in the opposite direction.

9. The method defined in claim 1 wherein step e) lasts between 2 and 6 minutes.

10. The method defined in claim 1 wherein at the start of step e) the rack has a temperature between 930° and 300° C.

11. The method defined in claim 1, further comprising between steps d) and e) the step of:

d') fitting heat-transfer blocks to the racks that in step e) engage the predetermined regions of the part and transmit heat thereto.

* * * * *